US005320304A

United States Patent [19]

Danielson

[11] Patent Number: 5,320,304

[45] Date of Patent: Jun. 14, 1994

[54] INTEGRATED AERODYNAMIC FIN AND STOWABLE TVC VANE SYSTEM

[75] Inventor: Arnold O. Danielson, Inyokern, Calif.

[73] Assignee: The United states of America as represented by the Secretary of the Navy, Washington, D.C.

[21] Appl. No.: 666,104

[22] Filed: Mar. 15, 1991

[51] Int. Cl.[5] ..... F42B 10/66

[52] U.S. Cl. ..... 244/3.22; 239/265.19; 244/3.21

[58] Field of Search ..... 244/3.21, 3.22, 3.3; 60/230; 239/265.19

[56] References Cited

U.S. PATENT DOCUMENTS

| | | | |
|---|---|---|---|
| H384 | 12/1987 | Dillinger et al. | 60/230 |
| 2,969,017 | 1/1961 | Kershner | 244/3.21 |
| 3,986,683 | 10/1976 | Ellison | 244/3.22 |
| 4,018,384 | 4/1977 | Fitzgerald et al. | 244/3.22 |
| 4,131,246 | 12/1978 | Rotmans | 244/3.22 |
| 4,143,837 | 3/1979 | Thunholm | 244/3.22 |
| 4,274,610 | 6/1981 | Bastian | 244/3.22 |
| 4,364,530 | 12/1982 | Ripley-Lotee et al. | 244/3.22 |
| 4,562,980 | 1/1986 | Deans et al. | 244/3.22 |
| 4,913,379 | 4/1990 | Kubota et al. | 244/3.22 |

*Primary Examiner*—Charles T. Jordan
*Attorney, Agent, or Firm*—John Forrest; Melvin J. Sliwka; Robert J. Hampsch

[57] ABSTRACT

An aerodynamic fin and stowable jet vane system preferably for rocket motor missile applications to control roll, pitch, and yaw, in either the aerodynamic or thrust flight control conditions, has a retractable and stowable aerodynamic vane integrated with a stowable thrust vector reaction steering system on a common support. The integrated aerodynamic fins and thrust vector control reduce the overall missile mainframe dimensions and are mounted on a single, space saving support.

20 Claims, 5 Drawing Sheets

INTEGRATED AERODYNAMIC FIN AND STOWABLE TVC VANE SYSTEM

BACKGROUND OF THE INVENTION

The present invention relates in general to an integrated aerodynamic fin and stowable jet vane system and pertains, more particularly, to an integrated system in a missile rocket motor. The integrated system of this invention is an improvement over the conventional thrust vector control (TVC) or jet vane retraction systems.

With the conventional retractable TVC system the jet vane could only be retracted if the jet vane was in a trailing position. The conventional missile air frame aerodynamic fin and TVC systems use a dual support shaft approach. The jet vanes and the aerodynamic fins are separately supported on individual support shafts.

Reference is made to U.S. Statutory Invention Registration (S.I.R.) No. H384 for a disclosure of a stowable, three-axis reaction-steering system control system. The present invention incorporates the TVC system disclosed in the identified reference.

Another drawback associated with existing missile airframe design is the reduction in overall system effectiveness since it is known that large wings or aerodynamic fins tend to limit the minimum size of a missile launcher and will require folding fins in an effort to reduce packing and storing volume. It is known to use folding aerodynamic fins which tend to be complex devices and which are known to introduce aerodynamic flutter. Existing missiles also have a drawback of prohibiting the use of smaller size missile launcher cells for aircraft.

SUMMARY OF THE INVENTION

Accordingly, it is an object of the present invention to provide an improved integrated aerodynamic fin and TVC system that is adapted for augmented aerodynamic fin and TVC control. With the aerodynamic fin and TVC system of this invention a stowable thrust vector reaction steering system is integrated into a body portion of the aerodynamic control fin.

Another object of the present invention is to provide an improved integrated aerodynamic fin and TVC system that is constructed to provide an augmentation of the aerodynamic fin control forces when the TVC or jet vane is stowed within the aerodynamic fin. Thus, the stowed jet vane itself becomes responsible for an increase of combined augmented aerodynamic fin and jet vane area.

A further object of the present invention is to provide an improved integrated aerodynamic fin and TVC system that is adapted for three axis control, that is roll, pitch, and yaw, when activated by insertion into a missile rocket motor nozzle to vector rocket motor exhaust.

Still another object of the present invention is to provide an improved integrated aerodynamic fin and TVC system that allows a reduction in aerodynamic fin span distance and planform area. The integrated system of this invention allows an overall missile airframe size reduction and particularly in the aerodynamic fin span dimension.

Still a further object of the present invention is to provide an improved integrated aerodynamic fin and TVC system that is adapted for allowing a smaller launcher dimension to house a missile incorporating the present invention with the reduced span dimensions. The integrated system of this invention is characterized by the potentially higher weapon loading density which is of particular importance for aircraft and ships where storage volume is a primary concern.

Another object of the present invention is to provide an improved integrated aerodynamic fin and TVC system that provides for a simple retro-fit of the improved control system of this invention for existing missile air frames. The improved integrated TVC mounting system allows for a flexible mission in which either the TVC, the aerodynamic fin or both are used to provide missile control.

A further object of the present invention is to provide an improved integrated aerodynamic fin and TVC system that is adapted to afford jet vane retraction at substantially any angular deflection position of the jet vane within a normal range of allowable jet vane deflection.

Still another object of the present invention is to provide an improved integrated aerodynamic fin and TVC system that allows a degree of aerodynamic control during periods when the TVC system is not used. The integrated system of this invention uses aerodynamic fins of reduced size for trim control and roll control, for example as would occur between pulses of a pulse-thrust rocket motor or during missions when TVC vanes are normally stowed until terminal maneuvers are required.

Still a further object of the present invention is to provide an improved integrated aerodynamic fin and TVC system that is constructed to operatively integrate the aerodynamic fin and the TVC onto a single space saving support.

To accomplish the foregoing and other objects of this invention there is provided an integrated aerodynamic fin and stowable TVC or jet vane system for controlling a reaction motor missile during aerodynamic and reaction thrust flight conditions. The integrated system comprises a thrust vector control (TVC) vane that inserts into an exhaust system of a reaction motor to control the direction of the reaction motor exhaust and an aerodynamic fin to stabilize and control the attitude of the missile.

An actuator moves a single support that supports both the aerodynamic fin and the TVC vane system. Another actuator activates a linkage assembly for moving the thrust vector control vane into and out of the exhaust system as required.

In the disclosed embodiment described herein, either the electric screw-jack or hydraulic actuator disclosed in S.I.R. H384 is incorporated to move the TVC vane into or out of the rocket exhaust as required.

In a preferred embodiment, the TVC vane pivot member of the support assembly is located forward of a leading edge of an airfoil portion of the TVC vane.

These and other objects and features of the present invention will be better understood and appreciated from the following detailed description of one embodiment thereof, selected for the purposes of illustration and shown in the accompanying drawings.

DETAILED DESCRIPTION

Figure 1:
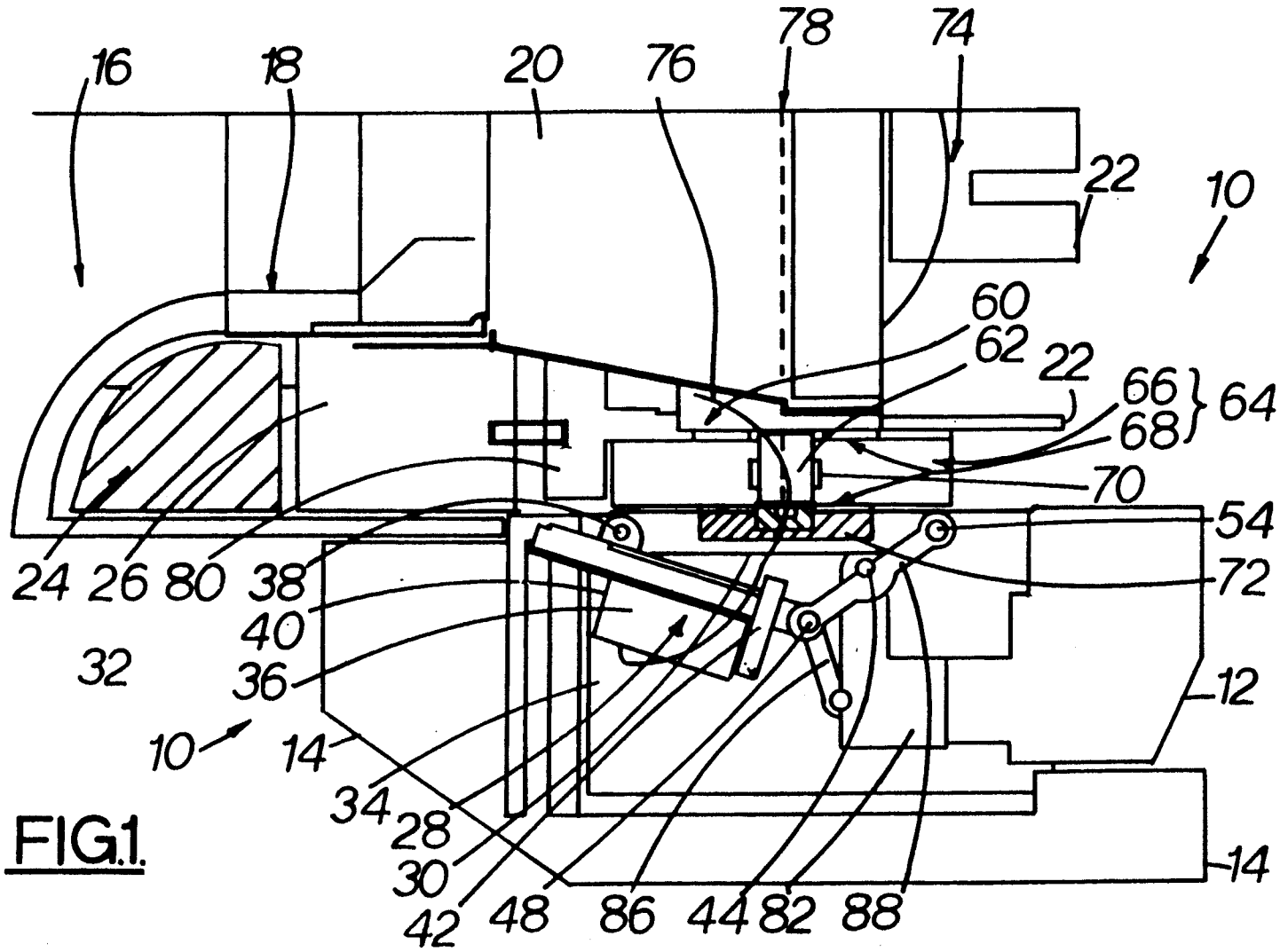
FIG. 1 is a schematic of an integrated aerodynamic fin and stowable TVC vane in accordance with the present invention showing the TVC vane in the stowed position.

Referring now to the drawings there is shown a preferred embodiment for the integrated aerodynamic fin and stowable TVC vane system of this invention. The system is described in connection with a missile application to integrate a TVC vane and an aerodynamic fin onto a single support. The integrated system of the present invention is particularly adapted for providing a smaller missile airframe and is characterized by an improved single member supported aerodynamic fin and TVC vane support system.

FIG. 1 of the drawings shows the integrated aerodynamic fin and TVC vane system 10 in conjunction with a SEA-SPARROW class missile including a plurality of TVC vanes 12 and aerodynamic wings or fins 14. These control surfaces are mounted at an aft portion of the missile adjacent a missile reaction motor 16 and more particularly proximate a blast tube portion 18 adjacent a nozzle 20 and a heat shield portion 22 of the reaction motor 16 as would be expected for conventional aft-mounted control surfaces in a conventional arrangement. A plurality of heat shields 22 are located adjacent the TVC vane locations in a preferred embodiment.

Further mounted within a missile air frame 32 and separated from the missile reaction motor 16 by suitable heat shielding, proximate the aft end of the missile, are a power supply 24 for operating a main aerodynamic fin and TVC vane actuator 26 and a TVC extension/retraction motor 28 associated with each integrated aerodynamic fin and vane assembly 10. The integrated aerodynamic fin and TVC vane assembly 10 uses a common integrated aerodynamic fin and TVC vane support 30 to mount the reduced size aerodynamic fin 14 and the TVC vane 12.

One integrated aerodynamic fin and TVC vane assembly 10 of the present invention will now be described with respect to the missile air frame 32 previously described. It is contemplated that each aerodynamic fin and TVC vane combination 10 on an air frame will incorporate the present invention. However, although not presently envisioned, there may occur configurations in which less than all of the aerodynamic fins incorporate a TVC vane assembly of this invention.

Figure 2:
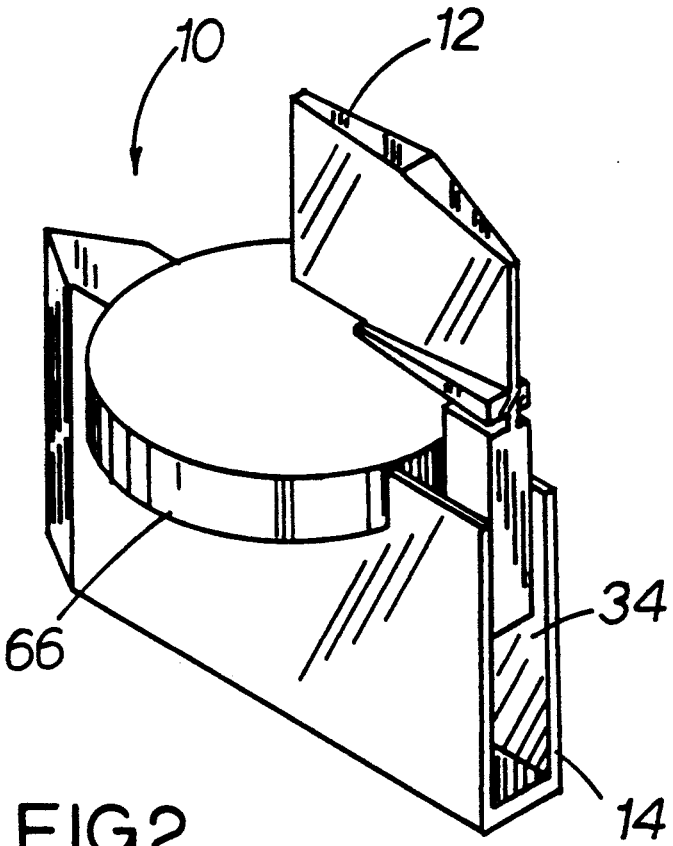
FIG. 2 is an isometric of an integrated aerodynamic fin and TVC vane control unit depicting the vane in an active position.
Figure 3:
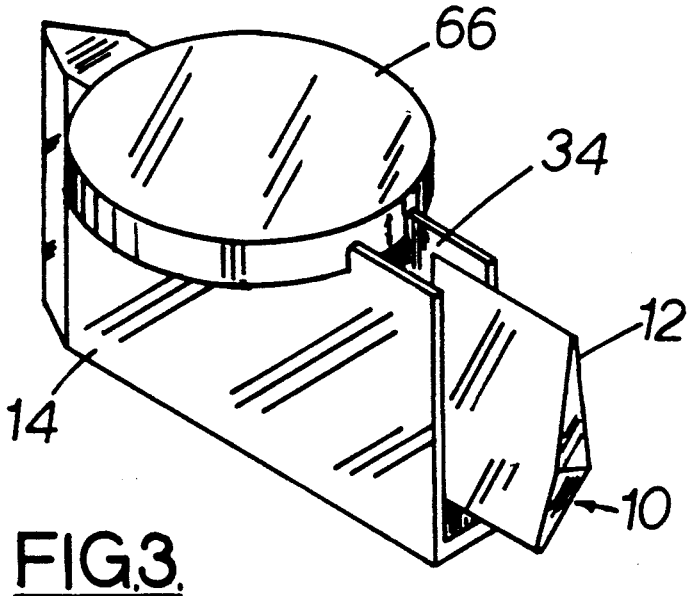
FIG. 3 is an isometric in which the TVC vane is in a stowed position.

The foregoing features of the present invention have a beneficial effect on the missile air frame 32 as depicted schematically in the accompanying drawing figures. This is due in part to the integration of the TVC vane 12 into an interior receptacle or hollow 34 defined by the aerodynamic fin 14, as shown in FIGS. 2 and 3.

The interior hollow or receptacle 34 is created or developed in the aerodynamic fin 14 by providing a general thickening of the aerodynamic fin 14 at its base in order to accommodate the TVC vane 12. The amount of thickening will be determined individually for each style of missile air frame as required. The hollowed out aerodynamic fin 14 provides a housing for the TVC vane 12 and the associated linkages and actuators described herein.

In a preferred embodiment, shown in FIG. 1, a TVC vane actuator 36, in association with the TVC extension/retraction motor 28, is mounted within the receptacle 34 and is preferable a screw-jack type actuator. It will be understood that a hydraulic cylinder or equivalent actuation device will provide the desired movement of the TVC vane 12 between a stowed position and an active position. The TVC vane actuator 36 pivots at actuator pivot 38 in order to accommodate the linkage motion described later.

It should be noted that the actuator pivot 38 is located at the integrated aerodynamic fin and TVC vane support 30 and will move with the integrated support 30 as the main aerodynamic fin and TVC vane actuator 26 operates to pivot or swing the aerodynamic fin 14 and TVC vane 12 together about a longitudinal axis 78 defined by the fin support 66 and generally perpendicular to a longitudinal axis defined by the missile reaction motor 16 and the missile air frame 32.

An airframe to aerodynamic fin support boss 60 attaches or otherwise connects to a proximate portion of the missile air frame 32 and allows for the desired swinging or rotation of the integrated aerodynamic fin and TVC vane support 30 about a longitudinal axis 78 defined by the combination of the fin support 66 and the central support shaft 62.

It is known to rotate an aerodynamic fin about the longitudinal axis of the missile air frame and it is known to rotate a TVC vane to control a missile during free flight and powered flight, respectively. The present invention integrates these movements by providing the single, integrated support member 30 for both the aerodynamic fin 14 and the TVC vane 12.

Reference may be made to the aforementioned Statutory Registration Document (S.I.R. No. H384) for a description of a conventional member supporting a TVC vane for a desired pivoting motion. In the present invention, linkage means are provided for moving TVC vane control means between the active and the stowed position.

In a preferred embodiment, a fixed actuator to pivot link 40 extends from the actuator pivot 38 to the TVC vane actuator assembly 36. The combination of the actuator pivot 38 and the actuator to pivot link 40 allows the TVC vane actuator assembly 36 to swing or rotate about the actuator pivot 38 as an actuator pushrod 42 moves into and out of the TVC vane actuator assembly 36. Movement of the actuator pushrod 42 operates to change the position of the TVC vane 12 with respect to its thrust vector control function.

The TVC vane 12 pivots about a TVC vane pivot point 44 either into or out of the nozzle 20 depending upon whether thrust vector control is required. In a preferred embodiment, TVC vane pivot point 44 is provided as depicted schematically in FIG. 1. A means for extending and stowing the TVC vane 12 is depicted schematically in FIGS. 4 and 5. The drawings illustrate a preferred TVC vane extension and retraction linkage assembly generally identified by reference character 46.

Figure 4:
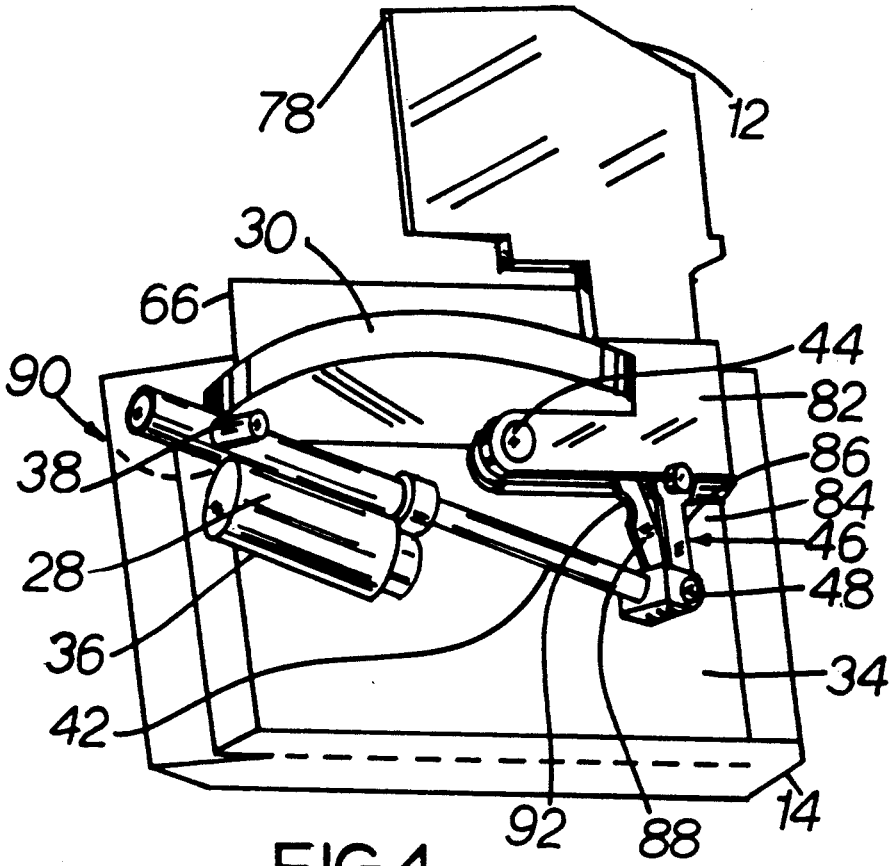
FIG. 4 is a partial section illustrating the TVC vane in an active position.
Figure 5:
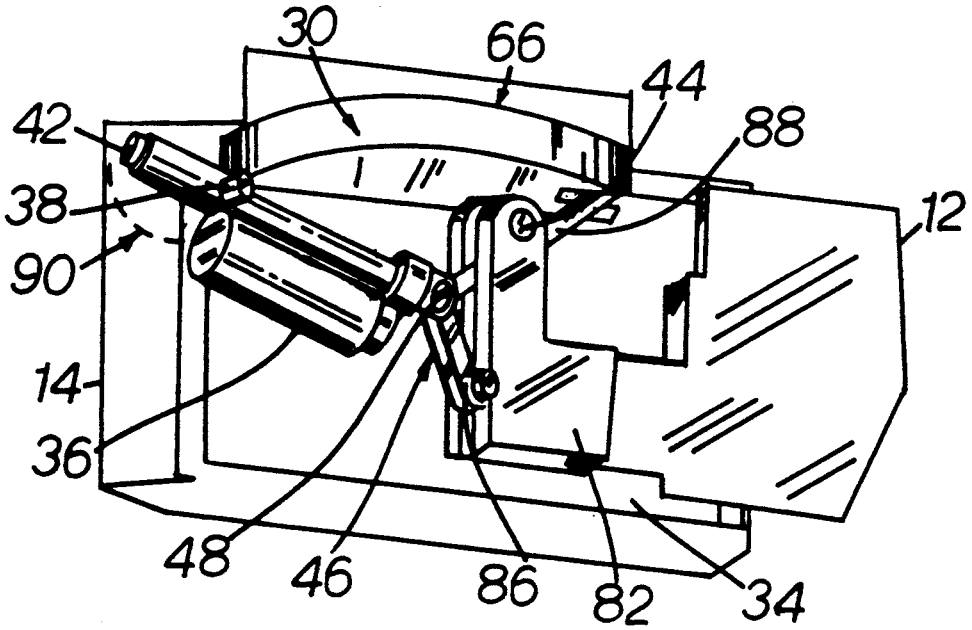
FIG. 5 is a partial section illustrating the TVC vane in a stowed position.

In a preferred embodiment, shown in FIGS. 4 and 5, the TVC vane extension and retraction linkage assembly 46 comprises a linkage assembly actuator pushrod pivot member 48 intermediate a support member link 88 and a cross link 86. A TVC vane mount 82 fixes TVC vane 12 to TVC vane pivot point 44. Completing the arrangement of the preferred embodiment illustrated in the drawings, (FIGS. 6 and 7) a linkage assembly support pivot 54 and TVC vane pivot point 44 completes TVC vane extension and retraction linkage assembly 46.

It should be understood that the integrated aerodynamic fin and TVC vane support assembly 30 integrates the TVC vane extension and retraction linkage assembly 46 and the aerodynamic fin 14 on the single fin support 66. The integrated assembly moves as a single unit with the TVC vanes 12 either stowed or in an active position within the missile reaction motor 16 exhaust. The TVC vanes 12 can be extended into the missile reaction motor 16 at any attitude of the fin support 66 and the aerodynamic fins 14.

In operation, in connection with the missile application previously mentioned which provides an integrated aerodynamic fin control and TVC vane assembly 12 mounted on a single fin support member 66, the TVC function of the invention operates substantially as disclosed and described in United States Statutory Invention Registration No. H384, with the further addition of the following features not mentioned hereinabove and illustrated in the accompanying drawing figures.

The improvements in the present invention reside in part in mounting the TVC vane actuator assembly 36 and TVC vane extension and retraction linkage assembly 46 on the common fin support 66 as further described below. As the missile fulfills its flight path and target objective the main aerodynamic fin and TVC vane actuator 26 effects a desired attitude control or change by moving the associated aerodynamic fin 14 and the TVC vane 12 simultaneously.

Referring again to FIG. 1, a partial sectional view of a preferred embodiment of the present invention is depicted in which the outer skin of the missile air frame has been removed to reveal the TVC vane actuator assembly 36. An air frame to aerodynamic fin support boss 60 supports the aerodynamic fin 14. A central support shaft 62 is centrally located with respect to a fin support ring assembly 64. The fin support ring assembly 64 includes a fin support 66, a pair of pancake bearings 68, and a side load bearing 70. A support ring retainer cap and nut assembly 72 is illustrated in the preferred embodiment.

Another support ring assembly 74 can be seen in FIG. 1. It will be understood that no other support ring assemblies have been shown solely for purposes of clarity of the drawing figures.

A possible actuator wire route from the air frame to actuator assembly 76 is illustrated in the schematic of FIG. 1 as a suggestion of the numerous possibilities for routing power and control wiring.

The aerodynamic fin 14 and TVC vane 12 are now seen to be mounted on a single fin support member 66 and pivoting within the rocket nozzle 20 and rotating on the fin support 66 about a TVC vane pivot axis 78. The main aerodynamic fin and TVC vane actuator 26 is clearly seen to include its drive shaft, and associated gear train.

FIG. 1 illustrates that fin actuator gear 80 meshes with the fin support 66 to rotate both the TVC vane 12 and the aerodynamic fin 14 mounted on the single fin support member 66.

The isometric of FIGS. 2 and 3 provide a forward looking view of the aerodynamic fin 14 and retractable TVC vane 12 control assembly. The integrated aerodynamic fin and TVC vane assembly 10 is removable and can be replaced by a conventional aerodynamic fin, a specialized fin (for a particular mission), or a conventional full-span (folding) fin since the aerodynamic fin size is entirely optional with the present invention. As previously mentioned, as the aerodynamic fin 14 size is reduced the fin planform can be augmented by the exposed portion of the TVC vane 12 in its retracted position.

The TVC vane 12 is depicted in the active position (FIG. 2) and in the retracted position (FIG. 3), and in the latter can be seen to augment the aerodynamic fin 14. In one preferred embodiment, as the missile enters a terminal free-flight condition, the TVC vanes can be retracted without any limitation due to any particular TVC vane deflection.

In a preferred embodiment, at the desired time in the missile's flight, the TVC vane 12 is retracted from the rocket nozzle 20 to its stowed position within the hollow receptacle 34. TVC vane retraction is accomplished by retracting the actuator pushrod 42 from an extended position as depicted in FIG. 4 to the retracted position depicted in FIG. 5. The TVC vane actuator assembly 36 drives the actuator pushrod 42.

The TVC vane extension and retraction linkage assembly 46 can be as fully described in Statutory Invention Registration No. H384. For example, it will be recognized from the identified S.I.R. No. H384 and the TVC vane extension and retraction linkage assembly 46 depicted schematically in the drawing figures that the TVC vanes 12 are locked into place when extended into the missile reaction motor 16 for their thrust vector control function.

The TVC vane actuator 36 of a preferred embodiment comprises a screw-jack driven by a small diameter, high-speed, geared-down electric TVC extension/-retraction motor 28. Electric power and control is provided in a preferred embodiment by wires fed through an actuator wire route from air frame to actuator assembly 76, and threaded through a hollow defined by the integrated aerodynamic fin and TVC vane assembly 30, and around the nozzle 20 and the blast tube 18. Conventional missile aft power systems and control electronics systems provide the necessary control logic and electrical power for the present invention.

It will be understood that conventional missile systems can be modified in accordance with the present invention.

The TVC vane 12 arrangement of a preferred embodiment of the present invention is rotated about the TVC vane pivot axis 78, that is, about the leading edge of the airfoil portion of the TVC vane 12. This hinge arrangement is depicted in the schematic representation of the invention shown in FIG. 1.

It will be understood that with this arrangement of rotating the TVC vane about its leading edge, rather than rearward of its leading edge as disclosed in S.I.R. No. H384, that the aerodynamic center of pressure on each TVC vane airfoil lies behind the hinge line for rotation.

It is believed that the location of the TVC vane leading edge pivot axis 78 provides positive, predictable, stable deflection and actuation torque characteristics. One skilled in the art will recognize the advantage of minimizing or at least stabilizing the torque change as the TVC vane is actuated. It will now be recognized that vane actuation torque is important as it relates to potential missile control system gain-switching requirements, which are known non-linear control features.

The TVC vane is shown in the active thrust vector control mode in FIG. 4 and in the stowed or inactive thrust vector control mode in FIG. 5.

As depicted in FIG. 4, the TVC vane 12 is inserted into the rocket plume with the actuator pushrod 42 fully extended. FIG. 5 depicts the TVC vane 12 fully retracted into the aerodynamic fin TVC vane receptacle 34. A minimum span aerodynamic fin 14 is illustrated to show augmentation of the aerodynamic fin 14 by the exposed portion of the retracted TVC vane 12. The face of the aerodynamic fin 14 is not shown to clearly illustrate the internal assembly.

A TVC vane mount 82 is preferably split to provide clearance for movement of the TVC vane extension and retraction linkage assembly 46, and in particular movable joint support link 88.

Figure 6:
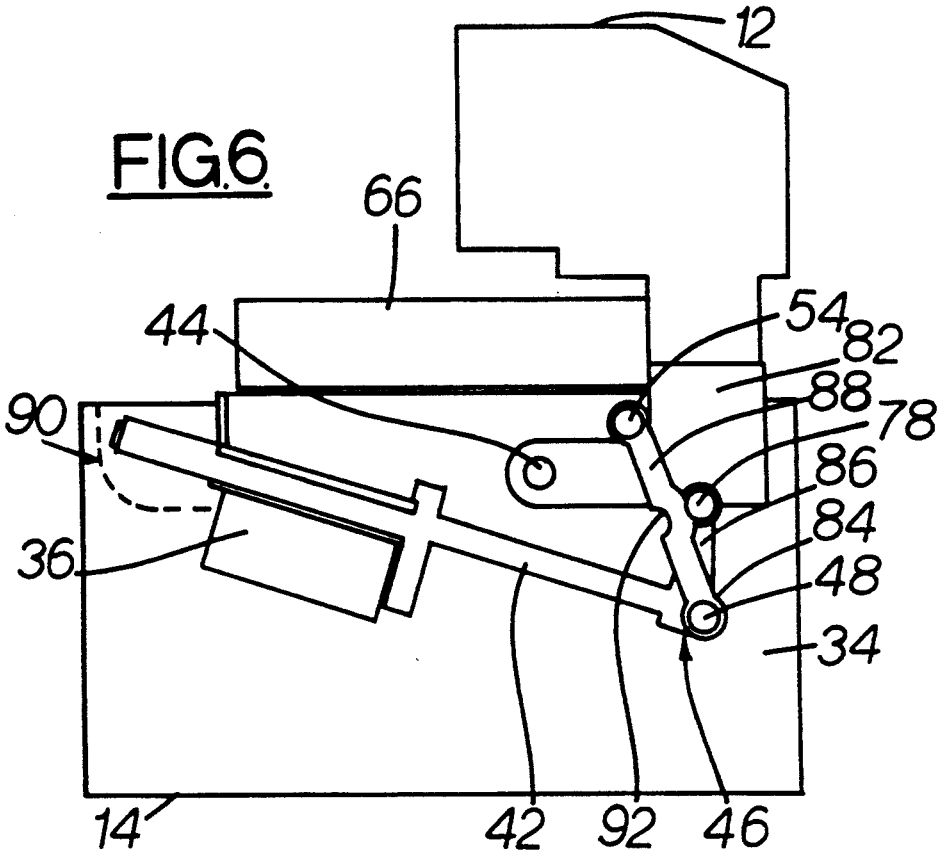
FIG. 6 is a partial section illustrating the actuator assembly in an active position.
Figure 7:
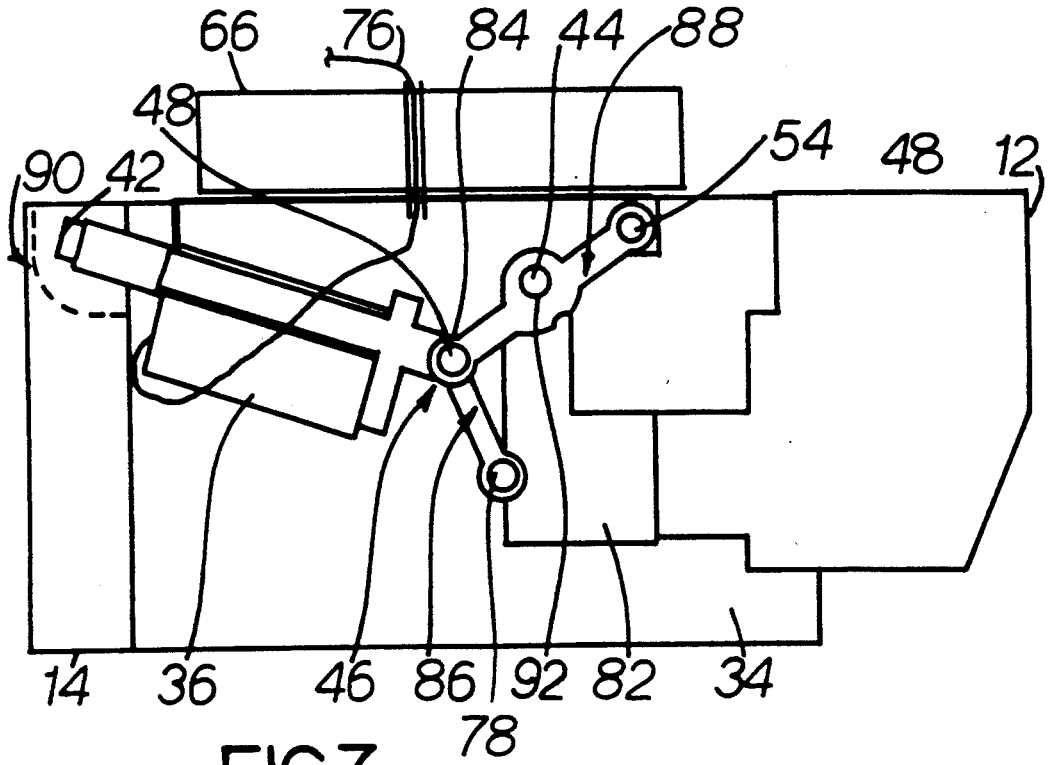
FIG. 7 is another partial section illustrating the actuator assembly in the stowed position.

Another side view of the TVC vane actuator 36 and linkage assembly 46 is shown in FIGS. 6 and 7, the former depicting the invention in the active thrust vector control position and the latter depicting the invention in the inactive or stowed thrust vector control position. FIG. 6 shows the extent of actuator pushrod 42 extension and FIG. 7 shows the extent of actuator pushrod 42 retraction with respect to the aerodynamic fin TVC vane receptacle or well 34.

Vane actuation is accomplished by means of the combination TVC vane extension and retraction linkage assembly 46, including cross link 86 and movable support link 88 with the illustrated anchor and joint locations. A forward portion of the aerodynamic fin 14 includes a push rod clearance well 90. The movable support link 88 includes a notch 92 to provide clearance for the TVC vane pivot point 44. Sideways or out-of-plane travel of the TVC vane extension and retraction linkage assembly 46 is prevented by the fin sides.

Figure 8:
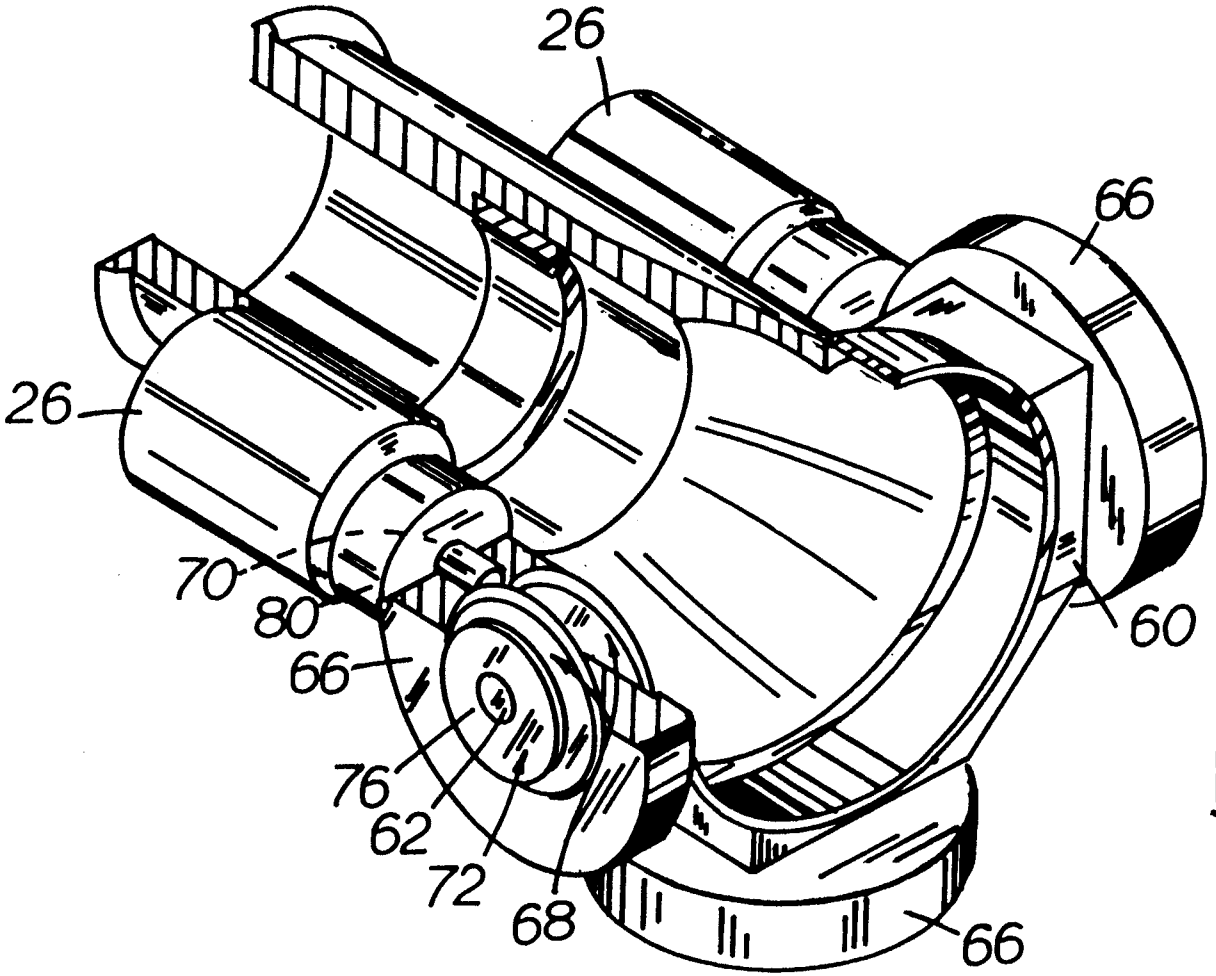
FIG. 8 is an isometric view of an air frame and actuator components.

FIG. 8 illustrates the components that are common to the airframes for every fin arrangement. The invention provides an airframe that is adaptable to a wide range of missions and one in which a simple change of fins enables optimization of the airframe configuration. The reduced span of the aerodynamic fins particularly allows the use of dense-pack launcher canisters for air to surface missions that might not otherwise be available to a mission controller or commander.

From the foregoing description those skilled in the art will appreciate that all of the objects of the present invention are realized. An improved integrated aerodynamic fin and thrust vector control vane system has been shown and described for providing the desired augmented aerodynamic fin and TVC vane control. With the aerodynamic fin and TVC vane system of this invention a stowable thrust vector reaction steering system is integrated into a body member of a aerodynamic control fin on a single support member, for example the illustrated support ring.

The construction of the present invention provides an improved integrated aerodynamic fin and thrust vector control vane system having an augmentation of the aerodynamic fin control forces when the vane is stowed to take advantage of the stowed vane to provide an increase of aerodynamic fin area. The integrated aerodynamic fin and thrust vector control vane system provides greater three-axis control for roll, pitch, and yaw, when the thrust vector control or jet vane is activated and the rocket motor is firing.

The integrated aerodynamic fin and vane system has a reduced aerodynamic fin span distance and planform area in view of the addition of the TVC vane, thereby reducing overall missile airframe size. The reduction in airframe size allows a missile incorporating the present invention to use a smaller launcher to house the missile. This results in a potentially higher weapon loading density. The integrated aerodynamic fin and TVC vane is readily retro-fit to existing missiles.

TVC vane retraction may be accomplished at substantially any angular deflection position of the vane within a normal range of deflection with the present invention. The present invention allows a degree of aerodynamic control during periods when the TVC vane system is not used, for example between pulses of a pulse-thrust rocket motor or during missions when TVC vanes are normally stowed until terminal maneuvers are required.

Finally, it will be understood from the foregoing description and the accompanying illustrations that a key feature of this invention is the use of a single space saving support member for attitude control of both the aerodynamic fin and the thrust vector control vane.

While specific embodiments have been shown and described, many variations are possible. The particular shape and size of the aerodynamic fin may be varied to reflect the advantage available from the integration of the stowed TVC vane for free flight control. Any size or shape variations will be dictated at least in part by conventional aerodynamic design conditions. Similarly, for the TVC vane size and shape, variations may be made to take advantage of the features of the improved system and its control on a single support member or ring.

In a preferred embodiment the pivots are provided by clevis and pin arrangements associated with the adjacent linkage members. Although the preferred embodiment describes the electric motor driven screw-jack, it will be understood from the disclosure of S.I.R. No. H384, that a fluid-operated actuator and linearly moving ram member are readily incorporated into the present invention.

Having described the invention in detail, those skilled in the art will appreciate that modifications may be made of the invention without departing from its spirit. Therefore, it is not intended that the scope of the invention be limited to the specific embodiment illustrated and described. Rather, it is intended that the scope of this invention be determined by the appended claims and their equivalents.

What is claimed is:

1. An integrated aerodynamic fin and thrust vector control vane system, comprising:

a thrust vector control vane for insertion into an exhaust system of a missile reaction motor to control the direction of the reaction motor exhaust;

an aerodynamic fin for stabilization and attitude control of the missile, the aerodynamic fin defining means for receiving the thrust vector control vane;

support means for supporting the thrust vector control vane and the aerodynamic fin, the support means movable to control the attitude of the aerodynamic fin and thrust vector control vane;

a first actuating means operatively connected to the support means for moving the support means;

a linkage assembly operatively connected to the thrust vector control vane; and a second actuating means operatively connected to the linkage assembly, the second actuating means providing movement of the linkage assembly for associated movement of the thrust vector control vane for insertion into and retraction from the exhaust system of the reaction motor, the second actuating means operatively connected to the support means such that movement of the support means results in movement of the thrust vector control vane, the aerodynamic fin, and the second actuating means.

2. An integrated aerodynamic fin and thrust vector control vane system as set forth in claim 1 wherein the thrust vector control vane is stowed in the thrust vector control receiving means of the aerodynamic fin, and the combination of the aerodynamic fin and stowed thrust vector control vane define an augmented control surface.

3. An integrated aerodynamic fin and thrust vector control vane system as set forth in claim 1 wherein the aerodynamic fin has a reduced span dimension and planform area.

4. An integrated aerodynamic fin and thrust vector control vane system as set forth in claim 1 wherein the vane and fin support means includes a single support member attached to a missile air frame.

5. An integrated aerodynamic fin and thrust vector control vane system as set forth in claim 4 wherein the single support member is a fin support ring.

6. An integrated aerodynamic fin and thrust vector control vane system as set forth in claim 1 wherein the first actuator means includes a motor and a main actuator assembly operatively connected from the motor to the support means.

7. An integrated aerodynamic fin and thrust vector control vane system as set forth in claim 1 wherein the linkage assembly includes a multiple linkage assembly.

8. An integrated aerodynamic fin and thrust vector control vane system as set forth in claim 1 wherein the second actuator means includes a linearly movable shaft for actuating the linkage assembly and moving the thrust vector control vane between the extended and the retracted positions.

9. An integrated aerodynamic fin and thrust vector control vane system as set forth in claim 1 wherein the second actuator means includes an electric screw-jack device.

10. An integrated aerodynamic fin and thrust vector control vane system as set forth in claim 1 wherein the second actuator means includes an hydraulic ram device and linearly moving shaft combination.

11. An integrated aerodynamic fin and thrust vector control vane system, comprising:

a thrust vector control vane for insertion into an exhaust system of a reaction motor of a missile airframe so as to control the direction of the reaction motor exhaust and the attitude of the missile air frame during flight;

an aerodynamic fin for stabilization and attitude control for the missile air frame, the aerodynamic fin having an interior hollow receptacle for receiving the thrust vector control vane in a stowed position;

a support member for supporting the thrust vector control vane and the aerodynamic fin, such that movement of the support member moves the aerodynamic fin and the thrust vector control vane;

an actuating means for moving the support member;

an assembly of linkages and pivots operatively associated with the thrust vector control vane; and a second actuating means operatively associated with the assembly of linkages and pivots, the second actuating means providing movement of the linkage and pivot assembly for associated movement of the thrust vector control vane for insertion into and retraction out of the exhaust system of the missile reaction motor and into a stowed position relative to the aerodynamic fin receptacle, the second actuating means operatively associated with the support member such that movement of the support member results in movement of the thrust vector control vane, the aerodynamic fin, and the second actuating means while allowing the second actuator to both stow and insert the thrust vector control vane for any position of the support member .

12. An integrated aerodynamic fin and thrust vector control vane system as set forth in claim 11 wherein the thrust vector control vane is stowed in the thrust vector control receiving means of the aerodynamic fin, and the combination of the aerodynamic fin and stowed thrust vector control vane define an augmented control surface, the augmented control surface including reduced span dimension and planform area.

13. An integrated aerodynamic fin and thrust vector control vane system as set forth in claim 11 wherein a thrust vector control vane pivot member is located forward of a leading edge of an airfoil portion of the thrust vector control vane.

14. An integrated aerodynamic fin and thrust vector control vane system as set forth in claim 11 wherein the second actuator means includes a linearly movable shaft for activating the linkage and pivot assembly and moving the thrust vector control vane between the extended and the retracted positions.

15. An integrated aerodynamic fin and thrust vector control vane system as set forth in claim 14 wherein the second actuator includes an electric screw-jack device.

16. An integrated aerodynamic fin and thrust vector control vane system as set forth in claim 14 wherein the second actuator includes an hydraulic ram device and linearly moving shaft combination.

17. A method for integrating an aerodynamic fin and thrust vector control vane system, which comprises:

hollowing out an interior receptacle within the aerodynamic fin for reception of the thrust vector control vane in a stowed position;

supporting a thrust vector control vane and an aerodynamic fin on a single support means; and actuating the single support means with a first actuating means so as to simultaneously actuate the thrust vector control vane and the aerodynamic fin.

18. A method for integrating an aerodynamic fin and thrust vector control vane system as set forth in claim 17, which further comprises:

locating the thrust vector control vane into an exhaust system of a reaction motor to control the direction of the reaction motor exhaust.

19. A method for integrating an aerodynamic fin and thrust vector control vane system as set forth in claim 17, which further comprises:

augmenting an aerodynamic fin control surface by the combination of the aerodynamic fin and the stowed thrust vector control vane.

20. A method for integrating an aerodynamic fin and thrust vector control vane system as set forth in claim 17, which further comprises:

pivoting the thrust vector control vane about a pivot located forward of a leading edge of an airfoil portion of the thrust vector control vane.

* * * * *